US011098968B1

(12) United States Patent
Roberts et al.

(10) Patent No.: US 11,098,968 B1
(45) Date of Patent: Aug. 24, 2021

(54) SLIDE LOCK-BACK FOLLOWER ASSEMBLY

(71) Applicant: Magpul Industries Corp., Austin, TX (US)

(72) Inventors: Timothy Eric Roberts, Broomfield, CO (US); Jeremy M. Fiester, Lafayette, CO (US); Cristopher McRae, Austin, TX (US)

(73) Assignee: Magpul Industries Corp., Austin, TX (US)

( * ) Notice: Subject to any disclaimer, the term of this patent is extended or adjusted under 35 U.S.C. 154(b) by 0 days.

(21) Appl. No.: 17/048,547

(22) PCT Filed: Jun. 26, 2020

(86) PCT No.: PCT/US2020/039793

§ 371 (c)(1),
(2) Date: Oct. 16, 2020

(87) PCT Pub. No.: WO2020/264274

PCT Pub. Date: Dec. 30, 2020

Related U.S. Application Data

(60) Provisional application No. 62/868,094, filed on Jun. 28, 2019.

(51) Int. Cl.

| | |
|---|---|
| ***F41A 9/75*** | (2006.01) |
| ***F41A 9/70*** | (2006.01) |
| ***F41A 17/36*** | (2006.01) |

(52) U.S. Cl.
CPC ..... *F41A 9/70* (2013.01); *F41A 17/36* (2013.01)

(58) Field of Classification Search
CPC ..... F41A 9/61; F41A 9/70; F41A 9/75; F41A 9/73; F41A 9/65; F41A 17/36; F41A 19/64

(Continued)

(56) References Cited

U.S. PATENT DOCUMENTS 1,921,871 A 8/1933 Gaidos
2,394,606 A * 2/1946 Gazda ..... F41A 9/73 89/34

(Continued)

OTHER PUBLICATIONS

Blaine R. Copenheaver, "International Search Report and Written Opinion Regarding International Application No. PCT/US2020/039793", dated Sep. 3, 2020, p. 14 Published in: US.

(Continued)

*Primary Examiner* — Michael D David
(74) *Attorney, Agent, or Firm* — Neugeboren O'Dowd PC

(57) ABSTRACT

This disclosure describes systems, methods, and apparatus for a follower assembly comprising one or more dummy cartridges, the first thereof comprising an angled follower platform that when pressed between the follower spring and a final live cartridge in the magazine, rotates to a first side of the magazine and enhances follower interaction with a slide lock mechanism. The follower platform may also be angled back to front to further enhance this interaction. The follower platform may include a protruding heel extending laterally from a front portion of the first side of the follower platform configured to interface with the slide lock mechanism. A rear stop may extend from a rear portion of the first side and interface with a downward-facing surface of the magazine near the feed end, wherein contact between these two surfaces causes a front end of the first dummy cartridge to rotate upward.

36 Claims, 14 Drawing Sheets

(58) Field of Classification Search
USPC ..... 42/50, 49.01; 89/33.01, 33.02
See application file for complete search history.

(56) References Cited

U.S. PATENT DOCUMENTS

| | | | | |
|---|---|---|---|---|
| 3,745,687 | A * | 7/1973 | Koon, Jr. | F41A 9/26 42/19 |
| 4,069,608 | A * | 1/1978 | Jurek | F41A 9/71 42/49.02 |
| 4,332,097 | A * | 6/1982 | Taylor, Jr. | F41A 9/73 42/50 |
| 4,487,103 | A * | 12/1984 | Atchisson | F41A 9/73 89/33.02 |
| 4,658,700 | A * | 4/1987 | Sullivan | F41A 9/37 89/33.02 |
| 4,689,907 | A * | 9/1987 | Gwinn, Jr. | F41A 9/73 42/50 |
| 4,745,842 | A * | 5/1988 | Shou-Fu | F41A 9/75 42/49.01 |
| 4,776,122 | A * | 10/1988 | Dieringer | F41A 9/65 42/50 |
| 4,926,742 | A * | 5/1990 | Ma | F41A 9/75 42/49.01 |
| 5,014,456 | A * | 5/1991 | Kurtz | F41A 9/65 42/50 |
| 8,117,956 | B2 | 2/2012 | Emde | |
| 8,448,364 | B2 * | 5/2013 | Davidson | F41A 9/69 42/50 |
| 8,485,083 | B1 * | 7/2013 | Care | F41A 9/75 89/33.02 |
| 8,733,224 | B2 | 5/2014 | Lasichak et al. | |
| 8,943,727 | B2 | 2/2015 | Russell | |
| 9,103,616 | B2 | 8/2015 | Wei | |
| 9,523,546 | B1 * | 12/2016 | Harding | F41A 9/71 |
| 9,664,470 | B2 | 5/2017 | No | |
| 9,939,217 | B2 | 4/2018 | Muska | |
| 10,018,437 | B2 | 7/2018 | Phipps et al. | |
| 10,060,691 | B2 * | 8/2018 | Kunz | F41A 9/70 |
| 10,082,353 | B1 | 9/2018 | Chaing | |
| 10,254,063 | B2 * | 4/2019 | Duhon | F41A 17/36 |
| 10,415,910 | B1 * | 9/2019 | Zukowski | F41A 9/70 |
| 10,921,075 | B2 * | 2/2021 | Brown | F41A 9/70 |
| 2011/0005114 | A1 * | 1/2011 | Snow | F41A 9/75 42/49.01 |
| 2011/0107901 | A1 * | 5/2011 | Lasichak | F41A 9/34 89/33.02 |
| 2011/0107902 | A1 * | 5/2011 | Quetschke | F41A 9/75 89/33.02 |
| 2012/0160083 | A1 * | 6/2012 | Rael | F41A 9/74 89/33.02 |
| 2014/0076137 | A1 * | 3/2014 | Lasichak | F41A 9/70 89/33.02 |
| 2015/0121736 | A1 * | 5/2015 | Faifer | F16F 1/04 42/49.01 |
| 2015/0292826 | A1 * | 10/2015 | Kielsmeier | F41A 9/70 42/50 |
| 2016/0102931 | A1 | 4/2016 | Roberts et al. | |
| 2016/0290749 | A1 * | 10/2016 | McCormick | F41A 9/66 |
| 2016/0313079 | A1 | 10/2016 | Vickers et al. | |
| 2017/0160032 | A1 * | 6/2017 | Overstreet | F41A 17/36 |
| 2017/0241729 | A1 * | 8/2017 | Gangl | F41A 17/36 |

OTHER PUBLICATIONS

Glockstore, "9MM (5ORD) Drum Magazine for Glocks", "Retrieved from https://www.glockstore.com/Glock-9MM-50RD-Drum-Magazine", Known to exist as early as May 7, 2019, p. 2.

Gunmag Warehouse, "KCI Glock 9MM 50-Round Durm Magazine", "Retrieved from https://gunmagwarehouse.com/kci-glock-9mm-50-round-drum-magazine.html", Known to exist as early as May 7, 2019, pp. 2.

European Patent Office, "Communication Pursuant to Rules 161(2) and 162 EPC Regarding European Application No. 20789436.1", Dec. 4, 2020, p. 3 Published in: EP.

Lichota, Catherine, "Reply to the Invitation Pursuant to Rules 161 & 162 EPC Regarding European Patent Application No. 20789436.1", Dec. 22, 2020, p. 12 Published in: EP.

* cited by examiner

SLIDE LOCK-BACK FOLLOWER ASSEMBLY

CLAIM OF PRIORITY UNDER 35 U.S.C. § 119

The present Application for Patent claims priority to Provisional Application No. 62/868,094 entitled "SLIDE LOCK-BACK FOLLOWER ASSEMBLY" filed Jun. 28, 2019, and assigned to the assignee hereof and hereby expressly incorporated by reference herein.

FIELD OF THE DISCLOSURE

The present disclosed embodiments relate generally to firearms. In particular, but not by way of limitation, the present disclosed embodiments relate to follower assemblies for firearm magazines.

DESCRIPTION OF RELATED ART

Currently, many firearm ammunition magazines utilize some type of follower assembly, typically along with a spring-based pushing mechanism, to feed ammunition from the magazine into a firearm. The follower assembly is generally situated behind an ammunition cartridge stack and is configured to push the cartridges along a path that exits the magazine through an open end of the magazine, often called the "feed end," which interfaces with a firearm. Specifically, in drum magazines, the feed end may be situated at the top of a feed tower, which attaches to a drum body that typically stores cartridges along a winding track with an overall spiral shape.

In some instances, drum magazines are specifically designed to interface with handguns (e.g., the SGM Tactical Glock 9 mm 50 Round Drum Magazine and the RWB Glock 9 mm 50 Round Drum Magazine). Such handguns may also include a slide mechanism, most commonly seen in semi-automatic handguns, that may be configured to interface with a slide lock mechanism, sometimes called a slide stop. Slide lock mechanisms may be engaged when a magazine has expended all of its cartridges providing a visual indicator that the magazine is empty as well as assisting in the reloading process. In some magazine types, a slide lock mechanism may be included in or interface with the follower assembly; however, certain characteristics of drum magazines in particular, such as their typically winding tracks, inhibit the use of known follower assemblies with slide lock mechanisms, such as those used in the more linear tracks of box magazines.

SUMMARY OF THE DISCLOSURE

The following presents a simplified summary relating to one or more aspects and/or embodiments disclosed herein. As such, the following summary should not be considered an extensive overview relating to all contemplated aspects and/or embodiments, nor should the following summary be regarded to identify key or critical elements relating to all contemplated aspects and/or embodiments or to delineate the scope associated with any particular aspect and/or embodiment. Accordingly, the following summary has the sole purpose to present certain concepts relating to one or more aspects and/or embodiments relating to the mechanisms disclosed herein in a simplified form to precede the detailed description presented below.

Some embodiments of the disclosure may be characterized as a follower for a magazine. The follower can include a first follower component comprising a front end, a rear end, and a first and second sides, and the first follower component can be part of a chain of follower components. The first follower component can also comprise an angled follower platform, a protruding heel, and a rear stop. The angled follower platform can be sloped from the first side to the second side. The protruding heel can extend substantially laterally from a front portion of the first side. The rear stop can extend from a rear portion of the first side. The rear stop can also be shaped to interface with a downward-facing surface of the magazine near the feed end of the magazine when the first follower component approaches the feed end, and can cause a front end of the first follower component to rotate upward relative to the rear stop.

Other embodiments of the disclosure may also be characterized as a follower assembly for a magazine comprising a first follower component comprising a front end, a rear end, and a first and second sides. The first follower component can comprise an angled follower platform, a protruding heel, and one or more additional follower components. The angled follower platform can be sloped from the first side to the second side. The protruding heel can extend substantially laterally from a front portion of the first side. The one or more additional follower components can form a chain with the first follower component and each can be movably linked to one or two other follower components.

Other embodiments of the disclosure can be characterized as a method of fabricating a follower assembly for a magazine. The method can include forming first follower component comprising a front end, a rear end, and a first and second sides. The first follower component can be formed to comprise an angled follower platform, a protruding heel, and a rear stop. The angled follower platform can be sloped from the first side to the second side. The protruding heel can extend substantially laterally from a front portion of the first side. The rear stop can extend from a rear portion of the first side and shaped to interface with a downward-facing surface of the magazine near a feed end of the magazine when the first follower component approaches the feed end. The rear stop can also cause a front end of the first follower component to rotate upward relative to the rear stop. The method can also include forming one or more additional follower components and linking them to form a flexible chain including the first follower component.

Other embodiments of the disclosure can be characterized as a method of using a follower assembly for a magazine. The method can include loading a plurality of live cartridges into a box or drum magazine. The method can further include pressing the follower assembly down within the magazine, wherein the follower assembly comprises a flexible chain of linked follower components including a first follower component. The first follower component can include an angled follower platform, a protruding heel, and a rear stop. The angled follower platform can be sloped from a first side to a second side. The protruding heel can extend substantially laterally from a front portion of the first side. The rear stop can extend from a rear portion of the first side and can be shaped to interface with a downward-facing surface of the magazine near a feed end of the magazine. The method can further include sequentially moving all but a final one of the plurality of live cartridges into a firearm from the magazine. The method can yet further include pressing the follower assembly upward against the final one of the plurality of live cartridges. A slope of the angled follower platform can cause the first follower component to rotate toward a first side of the magazine, thereby causing the protruding heel of the angled follower platform to press upwardly on a slide lock mechanism and lock a slide of the firearm in a rearward position. The method can further include pressing a top surface of the rear stop against the downward-facing surface of the magazine near the feed end of the magazine such that a front end of the angled follower platform rotates upward enhancing upward pressing of the protruding heel against the slide lock mechanism.

BRIEF DESCRIPTION OF THE DRAWINGS

Various objects and advantages and a more complete understanding of the present disclosure are apparent and more readily appreciated by referring to the following detailed description and to the appended claims when taken in conjunction with the accompanying drawings:

DETAILED DESCRIPTION

The word "exemplary" is used herein to mean "serving as an example, instance, or illustration." Any embodiment described herein as "exemplary" is not necessarily to be construed as preferred or advantageous over other embodiments.

There is currently a need for a follower assembly that is capable of smoothly traversing the winding track of a handgun drum magazine with minimal frictional force, while also reliably interfacing with a slide lock mechanism of a handgun (or bolt lock of a rifle or carbine) to lock the slide of the firearm in a rearward (or retracted or open or locked-back) position when the magazine no longer contains any live cartridges. The present disclosure addresses these issues with several novel design features.

This disclosure describes systems, methods, and apparatus for a follower assembly comprising one or more dummy cartridges, the first thereof comprising an angled follower platform that when pressed against a final live cartridge in the magazine, the angle of the platform causes the first dummy cartridge to rotate toward a first side of the magazine (e.g., a left side) and enhances follower interaction with a slide lock mechanism. The angled follower platform may include a protruding heel extending laterally from a front portion of the first side of the angled follower platform configured to interface with the slide lock mechanism when a final live cartridge in the magazine is chambered. The angled follower platform can be angled from this first side toward a second side, wherein the first side of the angled follower platform is proximal to the first side of the magazine (e.g., a left side of both). The angled follower platform may also be angled back to front to further enhance this interaction with the slide lock mechanism. A rear stop may extend from a rear portion of the first side and interface with a downward-facing surface of the magazine near the feed end, wherein contact between these two surfaces causes a front end of the first dummy cartridge to rotate upward further enhancing interaction with the slide lock mechanism. Although this disclosure often refers to "dummy cartridges," other follower components could be used in place of a structure that resembles a live cartridge. For instance, tubular follower components could be linked together to form a flexible chain of follower components with an angled follower platform atop the first of these follower components. In other cases, one or more, but not all, follower components in the flexible chain could include a dummy cartridge, while the other(s) follower components have a different shape, such as tubular.

Figure 1:
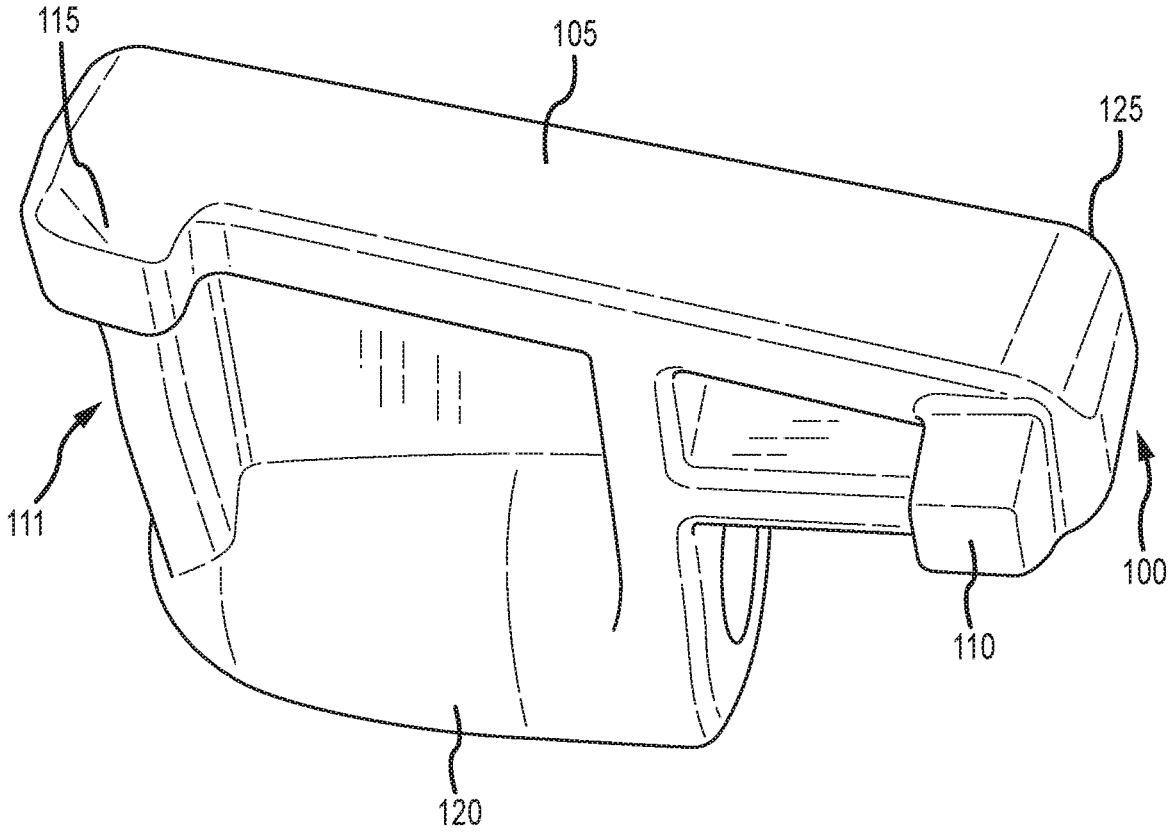
FIG. 1 illustrates an embodiment of a first dummy cartridge.
Figure 2:
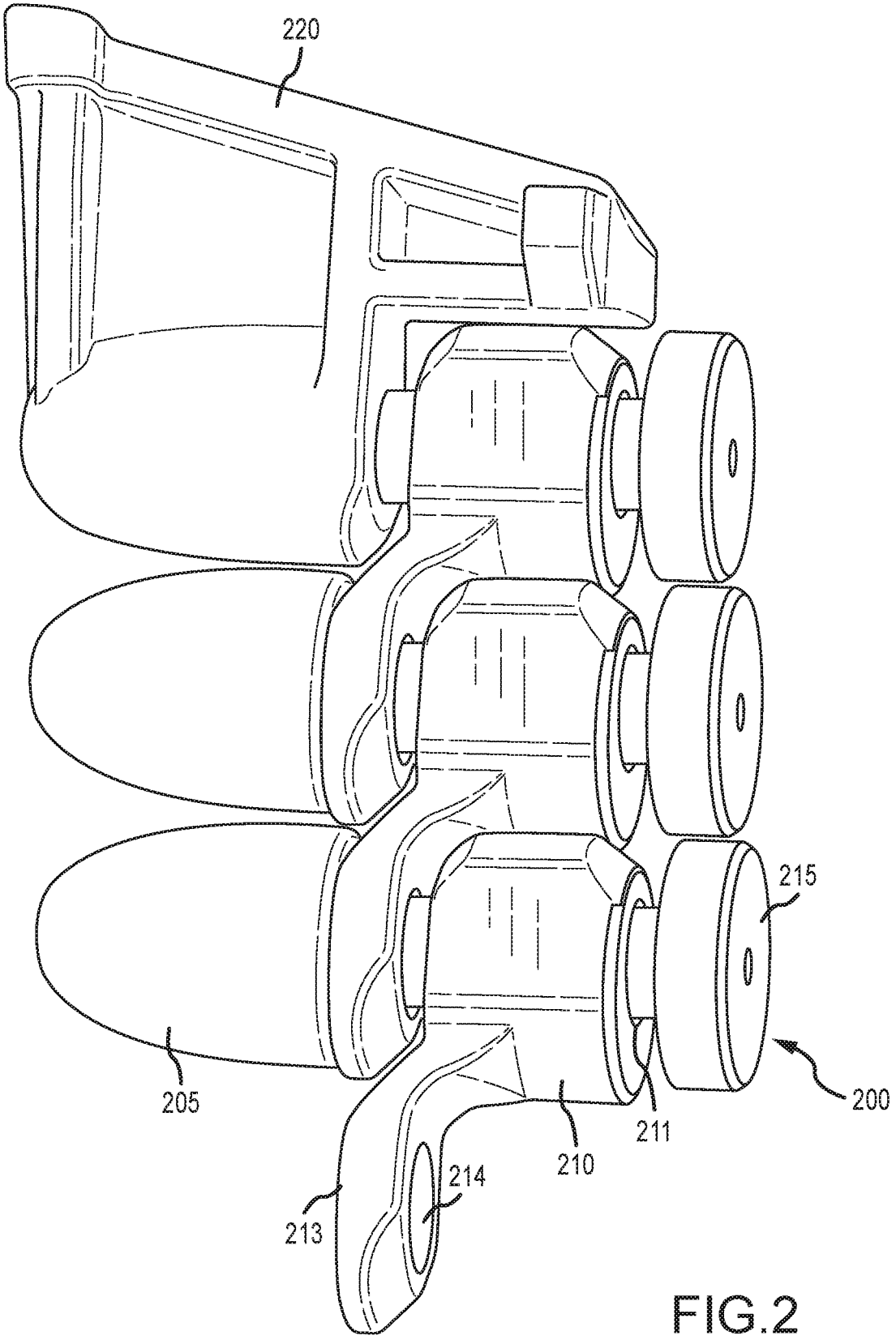
FIG. 2 illustrates an embodiment of a follower assembly.
Figure 3B:
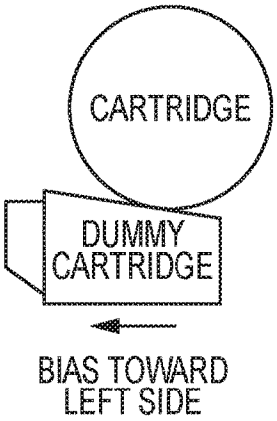
FIG. 3B illustrates a simplified diagram of a cross sectional view of a first dummy cartridge and a final live cartridge.
Figure 3A:
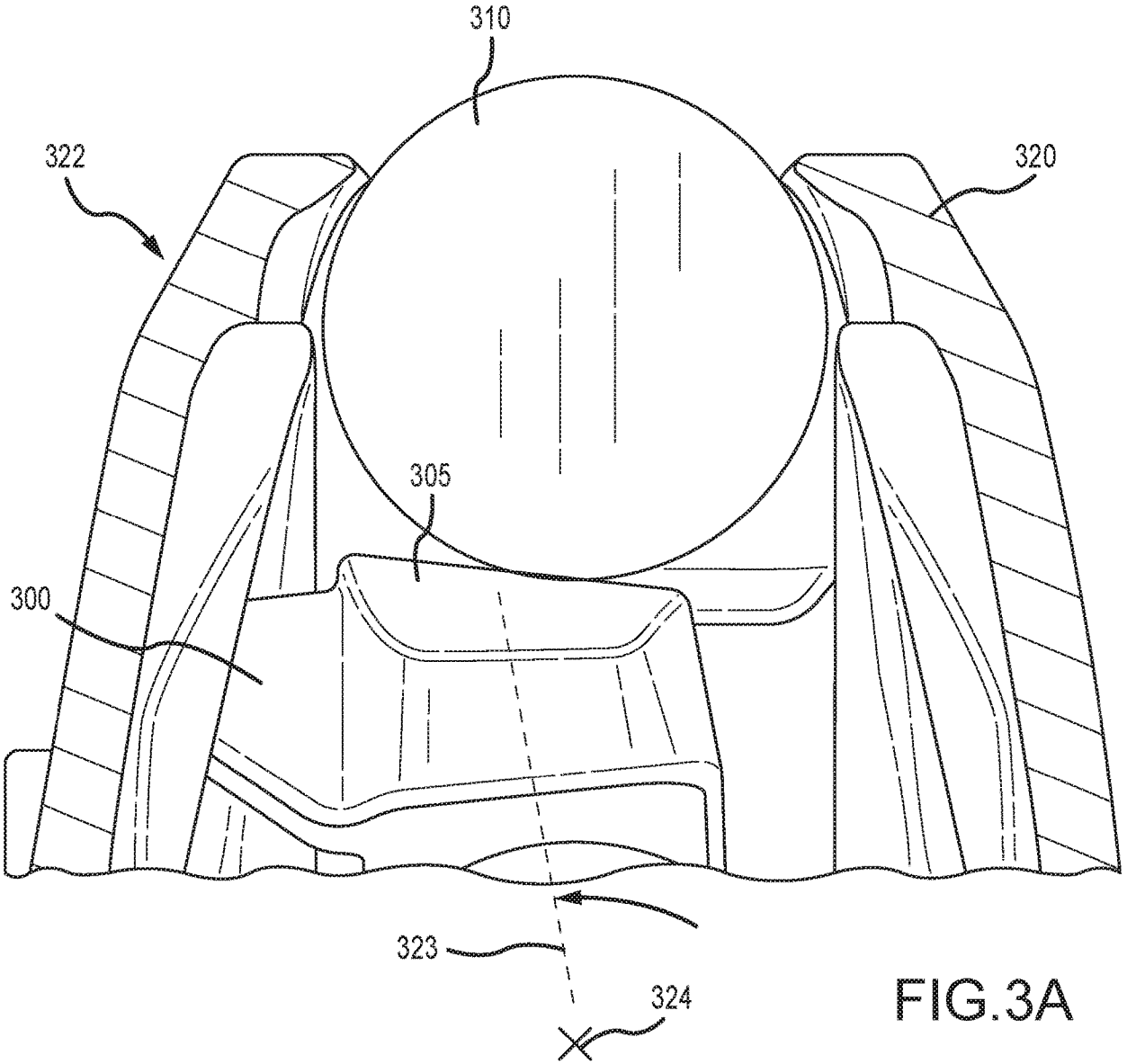
FIG. 3A illustrates a cross sectional view of a feed tower of a magazine including a follower assembly and a final live cartridge.

FIG. 1 illustrates an embodiment of the present disclosure that includes a first dummy cartridge 100 of a follower assembly (e.g., see 200 in FIG. 2). The first dummy cartridge 100 of a follower assembly may have an angled follower platform 105 configured to interface with a live cartridge, which may be the final live cartridge of a drum magazine (e.g., see FIG. 5). The angled follower platform 105 may be on a top-facing side of the first dummy cartridge 100 and may be configured to interface with a live cartridge at an angle relative to a longitudinal axis of a tower of the magazine. This angle may include front to back slope as well as side to side slope. For instance, FIG. 2 shows more clearly the front to back slope, while FIG. 3 shows more clearly the side to side slope. The front to back slope may bias the first dummy cartridge 100 towards a front of the magazine when the first dummy cartridge 100 is squeezed against a last live cartridge in the magazine, thereby enhancing the first dummy cartridge's interaction with the slide lock mechanism. This is important since cartridges, including the dummy cartridges in the follower assembly, tend to nose-dive in a drum magazine, and especially where pistol caliber cartridges are used. The front to back slope helps to counteract this nose-dive for the first dummy cartridge when the final live cartridge is expelled from the magazine. The side-to-side slope, in conjunction with a resistive force from the final live cartridge, may bias the first dummy cartridge 100 toward a first side of the magazine (e.g., the left side as seen in the simplified diagram of FIG. 3B). This bias allows or encourages a protruding heel 115 to engage a flange of a slide lock mechanism (e.g., see FIGS. 6-9), where such engagement might not occur without this lateral movement of the first dummy cartridge 100. The rotation toward the first side of the magazine can include either or both of rotational and translational movement. For instance, FIG. 3A shows a curved arrow from right to left indicating rotational leftward movement of the top of the angled follower platform 305 around a pivot axis 324. The pivot axis 324 may be roughly aligned with a barrel axis of the firearm in one embodiment, though this is not required. The first dummy cartridge 300 has been pushed to the first side 322 of the magazine in this illustration, and what is a vertical axis 323 while the follower assembly moves up through the feed tower, is now rotated toward the first side 322 of the magazine as the first dummy cartridge 300 is squeezed upward against the final live cartridge 310.

The slide lock mechanism (often used in a pistol) referred to throughout this application has similar function and structure to a bolt lock mechanism (often used in a rifle or carbine), and thus for purposes of this disclosure, a bolt lock mechanism can be used anywhere that a slide lock or slide lock mechanism is referenced. Further, while many firearms include a user interface for the slide lock mechanism on a left of the firearm (as illustrated throughout this disclosure), the apparatus disclosed herein can also be mirrored/flipped to apply to firearms where this interface is on the right of the firearm.

The front 111 of the forward-facing side of the first dummy cartridge 100 may also have a protruding heel 115 extending sideways from front 111 of the angled follower platform 105 (e.g., 1004 in FIG. 10), which may enable the first dummy cartridge 100 to better interface with the slide lock interface or mechanism of some firearms, particularly when a rear stop 110 causes the front 111 of the forward-facing side of the first dummy cartridge 100 to rotate up. In other embodiments, the rear stop 110 may protrude from a different side of the first dummy cartridge 100, such as the right side. In other embodiments, the rear stop 110 may have a non-planar forward-facing surface, such as a curved or irregular surface, configured to interface with a downward-facing surface of the magazine near the feed end of the magazine. In other embodiments, the rear stop 110 may be configured to cause the top of the forward-facing side of the first dummy cartridge 100 to rotate down when the rear stop 110 interfaces with a downward-facing surface of the magazine near the feed end of the magazine. In other embodiments, the protruding heel 115 may extend sideways from the top of the angled follower platform 105 (e.g., 1004 in FIG. 10).

Figure 4B:
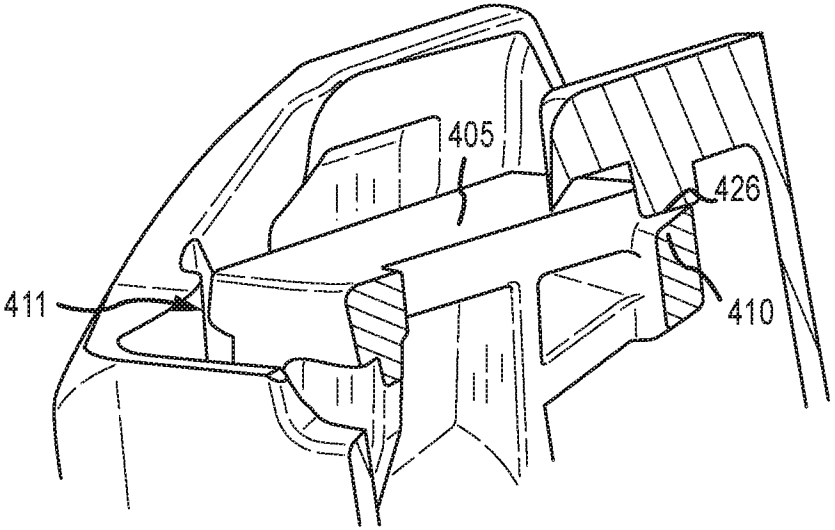
FIG. 4B illustrates a cross section perspective view of the feed tower and follower assembly of FIG. 4A.
Figure 4A:
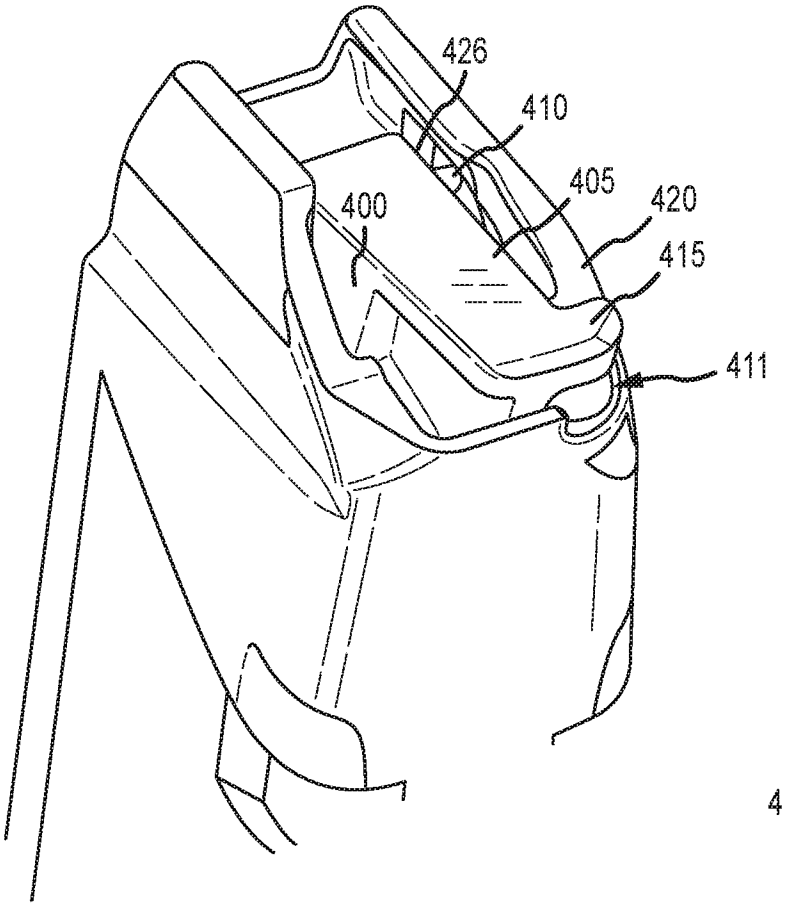
FIG. 4A illustrates a perspective view of a feed tower of a magazine including a follower assembly.

The first dummy cartridge 100 may also have a rear stop 110 configured to interface with a downward-facing surface of the magazine near the feed end of the magazine (more clearly seen in FIG. 4). The rear stop 110 may have a substantially planar forward-facing surface and may protrude from a first side (e.g., a left side) of the first dummy cartridge 100. The forward-facing surface may form an angle relative to the angled follower platform 105. The rear stop 110 may be configured to cause a front 111 of the first dummy cartridge 100 to rotate up when the rear stop 110 interfaces with the downward-facing surface of the magazine near the feed end of the magazine. The rear stop 110 may interface with the downward-facing surface of the magazine near the feed end of the magazine when the final live cartridge in the magazine is being chambered or after the final live cartridge has left the platform 105. The rotating up of the front 111 of the forward-facing side of the first dummy cartridge 100 caused by the rear stop 110, along with continued upward pressure on the first dummy cartridge, for instance, from a follower biasing mechanism in the box magazine or drum portion of a drum magazine, may assist in directing force from the protruding heel 115 into a slide lock mechanism, as seen for instance, in FIGS. 6-9.

Figure 14:
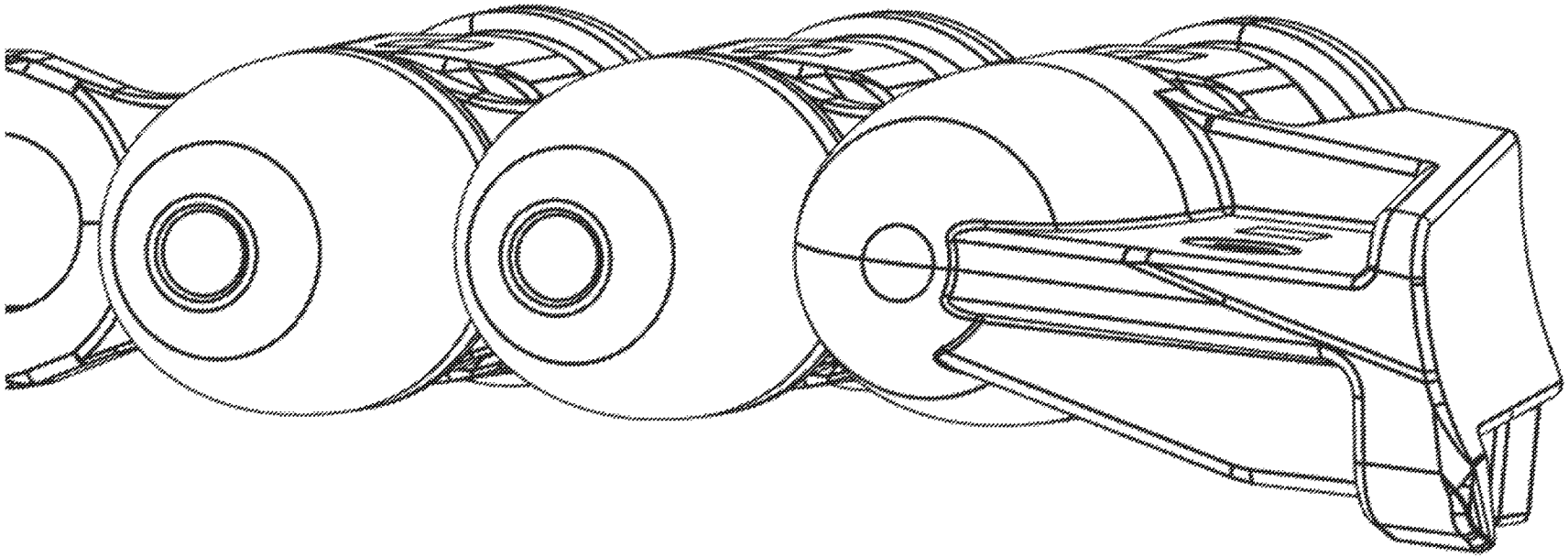
FIG. 14 illustrates an embodiment of a follower assembly, wherein the first follower component includes an angled follower platform having a curved (e.g., convex) portion thereon.

The angled follower platform 105 may be configured to partially protrude from the feed end of the magazine when no live cartridges remain in the magazine (e.g., see FIG. 4). The angled follower platform 105 may be substantially flat and planar, though angled; however, in other embodiments the angled follower platform 105 may have a curved or irregular surface (not shown) so as to provide an alternative interfacing with a live cartridge. For instance, see a non-limiting embodiment of a follower platform comprising at least one curved portion in the form of a convex curved portion in FIG. 14. The curved portion can be arranged atop the angled follower platform, and can be arranged on a right or left side of the angled follower platform. In other embodiments, the angled follower platform 105 may be configured to bias the first dummy cartridge 100 in a different direction than that shown in FIG. 1. However, the angled follower platform 105 biasing shown in FIG. 1 may be preferable to better align with and engage a slide lock interface or mechanism in some handguns or other firearms.

Returning to FIG. 1, the first dummy cartridge 100 can also include a slide ramp 125, which is angled relative to a direction of travel of the slide or bolt. In this way, when the slide or bolt impinges on the first dummy cartridge 100, the slide or bolt contacts this curved and/or angled slide ramp 125 and causes a downward pressure on the first dummy cartridge 100 that pushes the follower stack down and out of the way of the slide or bolt allowing the slide or bolt to move forward across the angled follower platform 105 without jamming. In other words, the slide ramp 125, can be configured to push the first dummy cartridge 100 down when contacted by a slide or bolt of a firearm.

The first dummy cartridge 100 may also have a cartridge-shaped portion 120 configured to interface with the magazine in a similar fashion to a live cartridge. The cartridge-shaped portion 120 may be of a similar shape to the live cartridges used in the magazine and may be positioned on a bottom-facing side of the first dummy cartridge 100. The cartridge-shaped portion 120 may enable the first dummy cartridge 100 to interface with the mechanisms of the magazine, such as the cartridge alignment and cartridge moving mechanisms, which may allow the first dummy cartridge 100 to move through the magazine in a fashion similar to a live cartridge. In other embodiments, the cartridge-shaped portion 120 may be positioned on the bottom-facing side or in the middle of the first dummy cartridge 100. In other embodiments, the first dummy cartridge 100 may not include a cartridge-shaped portion 120.

The first dummy cartridge 100 may be part of a follower assembly in a variety of magazine types, such as box or drum magazines; however, the first dummy cartridge 100 may be configured, for example by its dimensions and shape, to traverse a non-linear track, such as the winding tracks often found in drum magazines, while producing minimal frictional forces and maintaining proper alignment so as to avoid causing blockages or jams (e.g., avoiding nose diving of live cartridges). In one embodiment, a follower spring can be a torsional spring coupled to a rotatable arm, for instance, where a drum magazine is used.

FIG. 2 illustrates an embodiment of the present disclosure that includes a follower assembly 200 with a plurality of linked dummy cartridges 205 that are linked to a first dummy cartridge 220, such as the first dummy cartridge 100 of the FIG. 1 embodiment. Each of the linked dummy cartridges 205 may be of a similar shape to the live cartridges used in the magazine enabling the linked dummy cartridges 205 to interface with the mechanisms of the magazine, such as the cartridge alignment and cartridge moving mechanisms, which may allow the linked dummy cartridges 205 to move through the magazine in a fashion similar to live cartridges. The linked dummy cartridges 205 and the first dummy cartridge 220 may be linked together using a series of links 210 and rollers 215. Each roller 215 can include a pin portion that passes through a corresponding link 210, and a head portion having a larger diameter than the pin portion and shaped to interface with and roll along inner sides of a magazine. Each roller 215 may pass through a first hole 211 in a link 210 and into a hole (not visible) in a linked dummy cartridge 205 or the first dummy cartridge 220, rotatably coupling the link 210 to the linked dummy cartridge 205 or the first dummy cartridge 220. Each link 210 may have a protruding portion 213 with a second hole 214 configured to allow a roller 215 of the following adjacent linked dummy cartridge 205 to pass through, rotatably coupling the link 210 of one linked dummy cartridge 205 to the following adjacent linked dummy cartridge 205. The second hole 214 of the last link 210 in the follower assembly 200 may have no roller 215. The second hole 214 of the link 210 of the preceding linked dummy cartridge 205, or first dummy cartridge 220, may be positioned below the first hole 211 of the link 210 of the current linked dummy cartridge 205; however, in other embodiments, the second hole 214 of the link 210 of the preceding linked dummy cartridge 205, or first dummy cartridge 220, may be positioned above the first hole 211 of the link 210 of the current linked dummy cartridge 205. The resulting chain of linked dummy cartridges 205 and first dummy cartridge 220 allows each adjacent pair of linked dummy cartridges 205, or first dummy cartridge 220 and the adjacent linked dummy cartridge 205, to rotatably move about each other around a rotational axis passing through the corresponding roller and a hole in the corresponding link. In other words, the first and second dummy cartridges can rotate relative to each other around this rotation axis through the cartridge-like portion of the first dummy cartridge, and/or around a rotational axis through the second dummy cartridge and its roller. As a consequence, the follower assembly 200 may have a high degree of flexibility enabling it to traverse non-linear tracks within a magazine, such as the winding tracks of a drum magazine. This also allows the first dummy cartridge to rotate toward a first side around the rotational axis passing through the roller of the first dummy cartridge, when the first dummy cartridge is pressed against a bottom of the final live cartridge in the magazine. In addition to, or in the alternative, this rotation may be about an axis passing through a roller of the second dummy cartridge. However, in in many embodiments, while the first dummy cartridge extends at least partially above the feed end of the magazine and thus has the room to rotate toward the first side, the second dummy cartridge is typically still constrained from similar rotation by sides of the magazine. Each linked dummy cartridge 205, link 210, and roller 215 may combine to form a roughly cartridge-like shape enabling the follower assembly 200 to interface with the mechanisms of the magazine, such as the cartridge alignment and cartridge moving mechanisms, which may allow the follower assembly 200 to move through the magazine in a fashion similar to a stack of live cartridges.

FIG. 3 illustrates a cross sectional view of a feed tower of a magazine including a follower assembly and a final live cartridge 310. This cross-sectional view is taken from the rear. The first dummy cartridge 300 may be the same first dummy cartridge 100 or 220 as shown in FIGS. 1 and 2. The angled follower platform 305 may be configured to interface with a live cartridge 310 so as to bias the first dummy cartridge 300 towards a first side 322 of a magazine (or a left side when viewed from the rear). This bias toward the first side 322 of the magazine may enable the first dummy cartridge 300 to better align with and engage a slide lock mechanism (not shown). For instance, this interaction can be better seen in FIGS. 6-9. Because the first dummy cartridge 300 and subsequent dummy cartridges need to traverse the spiraling interior of a drum magazine, the width of these dummy cartridges is preferably less than a corresponding follower in a straight box magazine. However, this narrower width means that the first dummy cartridge 300 is less likely and, in some cases, unable to interface with a typical slide lock mechanism. Thus, the translation and/or rotation of the first dummy cartridge 300 in this disclosure helps the protruding heel to interface with the slide lock mechanism. Although not shown, this translation and/or rotation may not occur while the first dummy cartridge 300 is passing through the drum magazine and the feed tower (e.g., the feed tower may constrain such translation and/or rotation of the first dummy cartridge 300). Only when the protruding heel has cleared a top of the feed lips may this translation and/or rotation be possible.

FIG. 4 illustrates an embodiment of the present disclosure that includes a first dummy cartridge 400 at its maximum extent of vertical travel. The first dummy cartridge 400 may be the same first dummy cartridge 100 as shown in the embodiments of FIG. 1, 2, or 3. The first dummy cartridge 400 can include an angled follower platform 405, a rear stop 410, and a protruding heel 415. The first dummy cartridge 400 can also have a front 411. The first dummy cartridge 400 is here shown at or near a feed end 420 of the feed tower of a magazine. The feed end 420 can include a downward-facing surface 426 facing down that is shaped and arranged to interface the rear stop 410 when no live cartridges remain in the magazine. The rear stop 410 can extend laterally from the first dummy cartridge 400 in a same direction of extension as the protruding heel 415 (e.g., left in the figures). The rear stop 410 may be level with a plane of the angled follower platform 405 or position slightly below a plane of the angled follower platform 405. The rear stop 410 may be configured to cause a front 411 of the first dummy cartridge 400 to rotate up when the rear stop 410 interfaces with a downward-facing surface 426 near the feed end 420 of the magazine (e.g., by being arranged rearward of a center of gravity of the first dummy cartridge 400). In particular, as the rear stop 410 is arranged toward a rear of the angled follower platform 405, or at least rearward of a center of the angled follower platform 405, and as a follower spring pushes up on the follower assembly, for instance, through a rotatable arm, having a center of force forward of the rear stop 410, and as a blocking force rearward of this point is encountered, the front 411 rotates up with rotation roughly centered around the downward-facing surface 426. The rotating or tilting up of the front 411 of the first dummy cartridge 400 caused by interfacing of the rear stop 410 and downward-facing surface 426 may cause the first dummy cartridge 400, particularly a protruding heel 415 thereof, to further extend above the feed end 420 of the magazine and assist in interfacing with and directing force into the slide lock mechanism. The rear stop 410 can have a tilt, for instance from back to front as best seen in FIG. 4B, that assists in causing the front 411 to rotate upward. In particular, since the downward-facing surface 426 meets a rear of a top of the rear stop 410 first, this causes a torque tending to push the front 411 upward until the full top surface of the rear stop 410 can contact the downward-facing surface 426. In one embodiment, the follower spring can be a torsional spring coupled to a rotatable arm.

While the rear stop 410 is shown toward a rear of the angled follower platform 405, any position rearward of a middle of the angled follower platform 405, any position rearward of a center of gravity of the angled follower platform 405, or any position rearward of a point where an average force from the follower spring is applied to a top of the angled follower platform 405, can also be implemented. In other words, the rear stop 410 can be arranged anywhere along the first dummy cartridge 400 that causes a front of the first dummy cartridge 400 to rotate upwards when the rear stop 410 and the downward-facing surface 426 come into contact (i.e., upon exit of a final live cartridge from the magazine).

Figure 5:
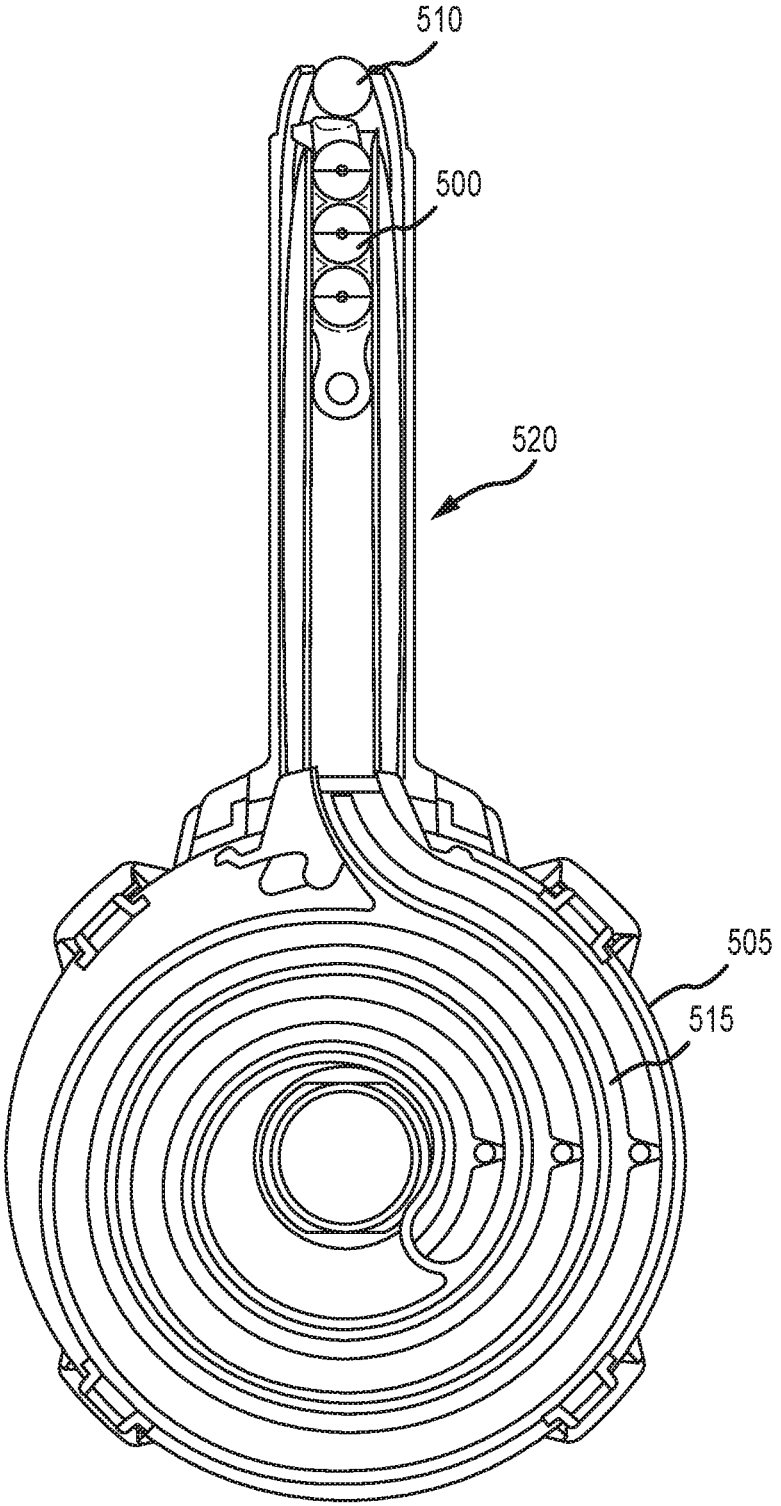
FIG. 5 illustrates an embodiment of a follower assembly positioned within a feed tower of a drum magazine.

FIG. 5 illustrates an embodiment of the present disclosure that includes a follower assembly 500 positioned within a feed tower 520 of a drum magazine. The follower assembly 500 may be the same follower assembly 200 as shown in the FIG. 2 embodiment. The follower assembly 500 may be configured to interface with a live cartridge 510 so as to cause a sideways bias (leftward in this embodiment) on the follower assembly 500 when the follower assembly 500 is in the feed tower 520, and to thereby cause a protruding heel of a first dummy cartridge of the follower assembly 500 to translate and/or rotate leftward once it clears a feed end of the feed tower 520. In an embodiment, one or more angles of an angled follower platform of the first dummy cartridge can be selected to cause this translation and/or rotation. For instance, the angled follower platform may be angled side to side when viewed from behind as in FIG. 5, and optionally may also be tilted front to back. The follower assembly 500 may interface with a mechanism for moving cartridges within the drum magazine body 505, such as a follower spring. In one embodiment, the follower spring can be a torsional spring coupled to a rotatable arm. The cartridge-like size and shape of the linked dummy cartridges may enable the follower assembly 500 to mimic a live cartridge stack and traverse a spiral track 515 while producing minimal frictional forces and maintaining proper alignment so as to avoid blockages or jams. When no live cartridges remain in the magazine, a protruding heel of the angled follower platform of the follower assembly 500 may extend beyond the end or top of the feed tower 520 to engage a slide lock mechanism (not shown). A rear stop on the follower assembly 500 may interface with a downward-facing surface near the top of the feed tower 520 causing a front of the first dummy cartridge of the follower assembly 500 to rotate up and extend even further beyond the end or top of the feed tower 520 of the magazine. This rotation assists in interfacing with and directing force into the slide lock mechanism (not shown). The rear stop can be arranged toward a rear of the first dummy cartridge from a center of gravity thereof.

Figure 6:
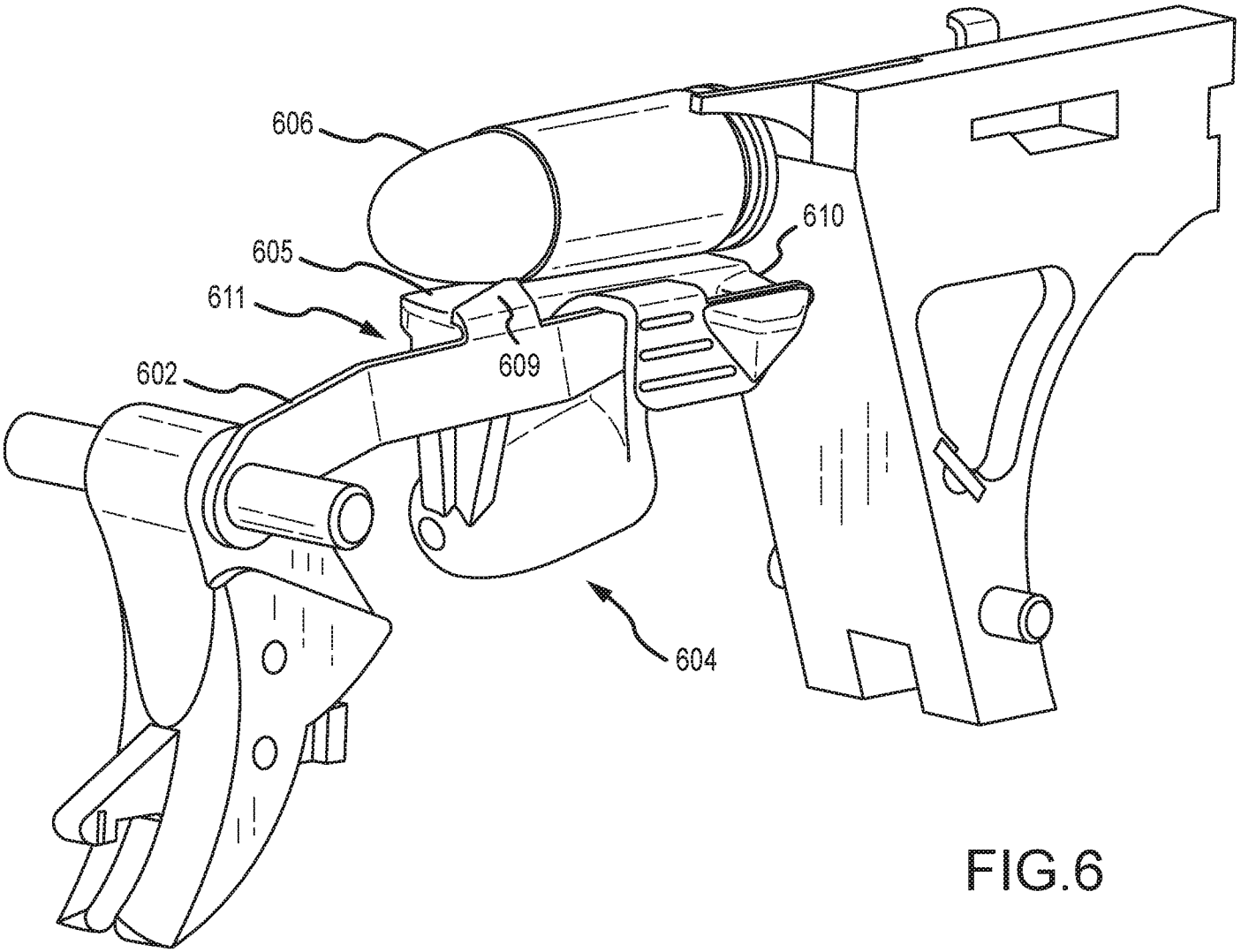
FIG. 6 illustrates an embodiment of an inside of a magazine showing the final live cartridge and first dummy cartridge of the follower assembly interfacing with a slide lock mechanism with various other components of the firearm hidden.
Figure 7:
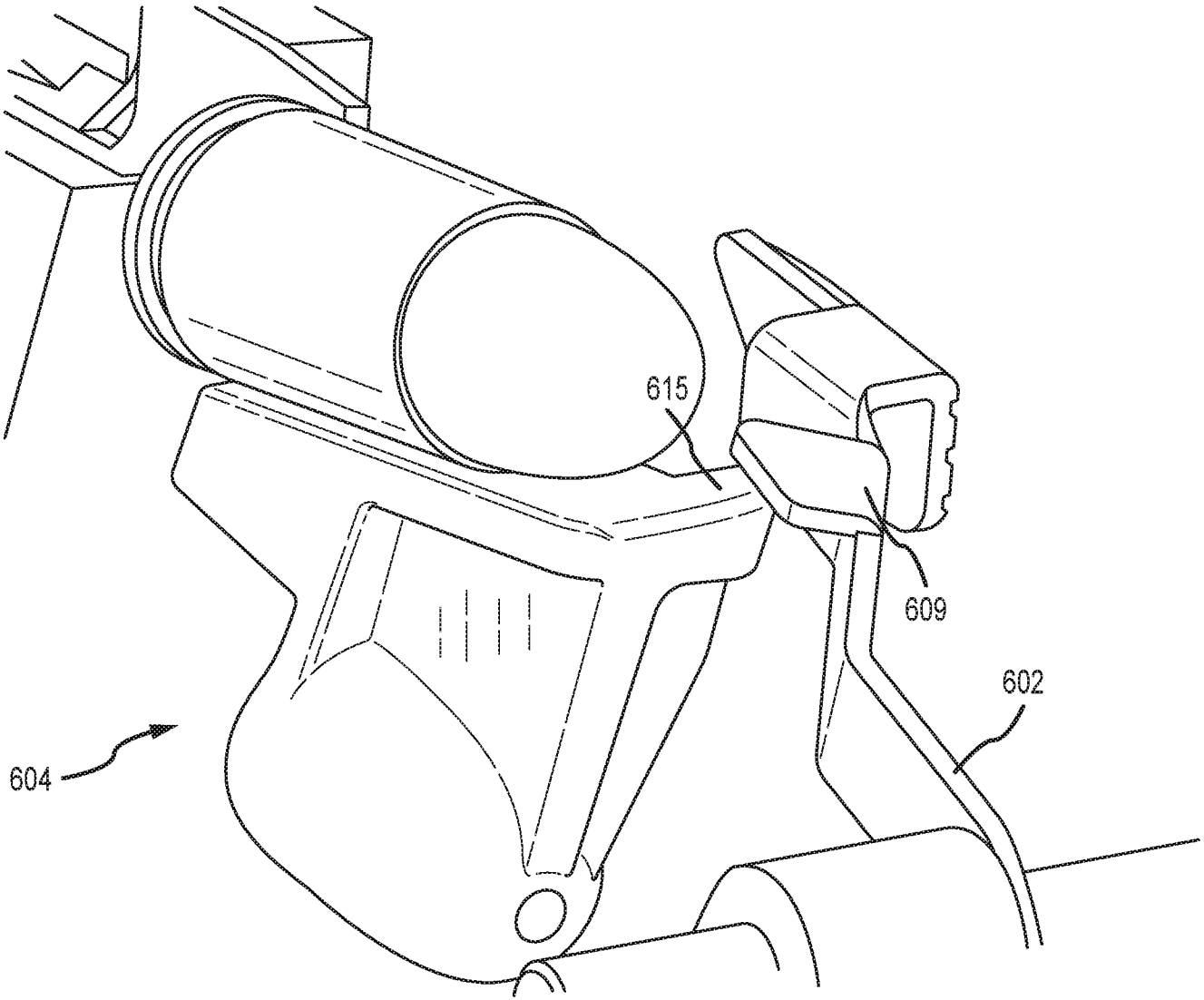
FIG. 7 illustrates another view of the final live cartridge and first dummy cartridge of the follower assembly of FIG. 6 with various other components of the firearm hidden.
Figure 8:
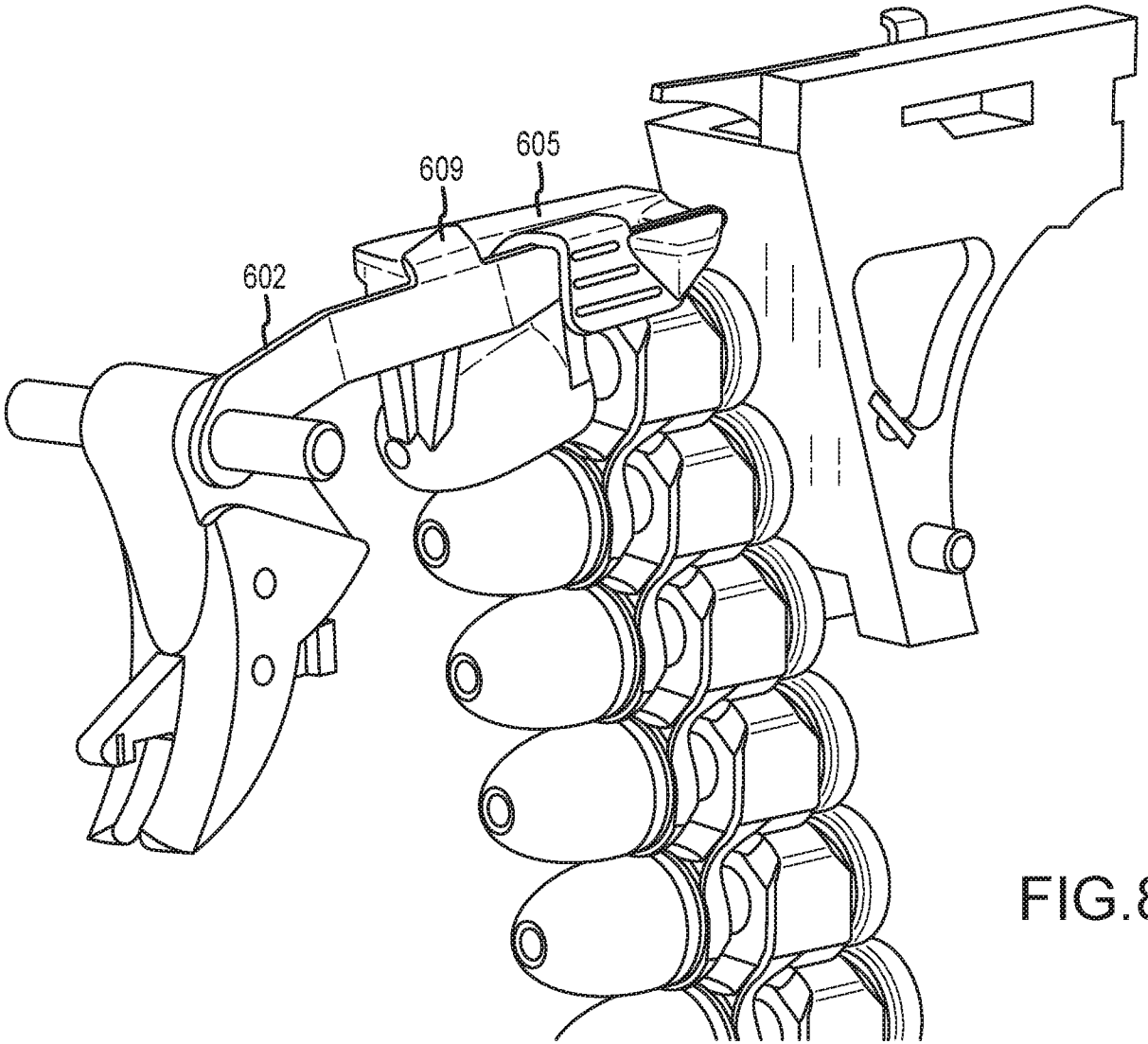
FIG. 8 illustrates another view of the first dummy cartridge of the follower assembly with the final live cartridge hidden of FIG. 6, but here with the rest of the follower assembly visible.
Figure 9:
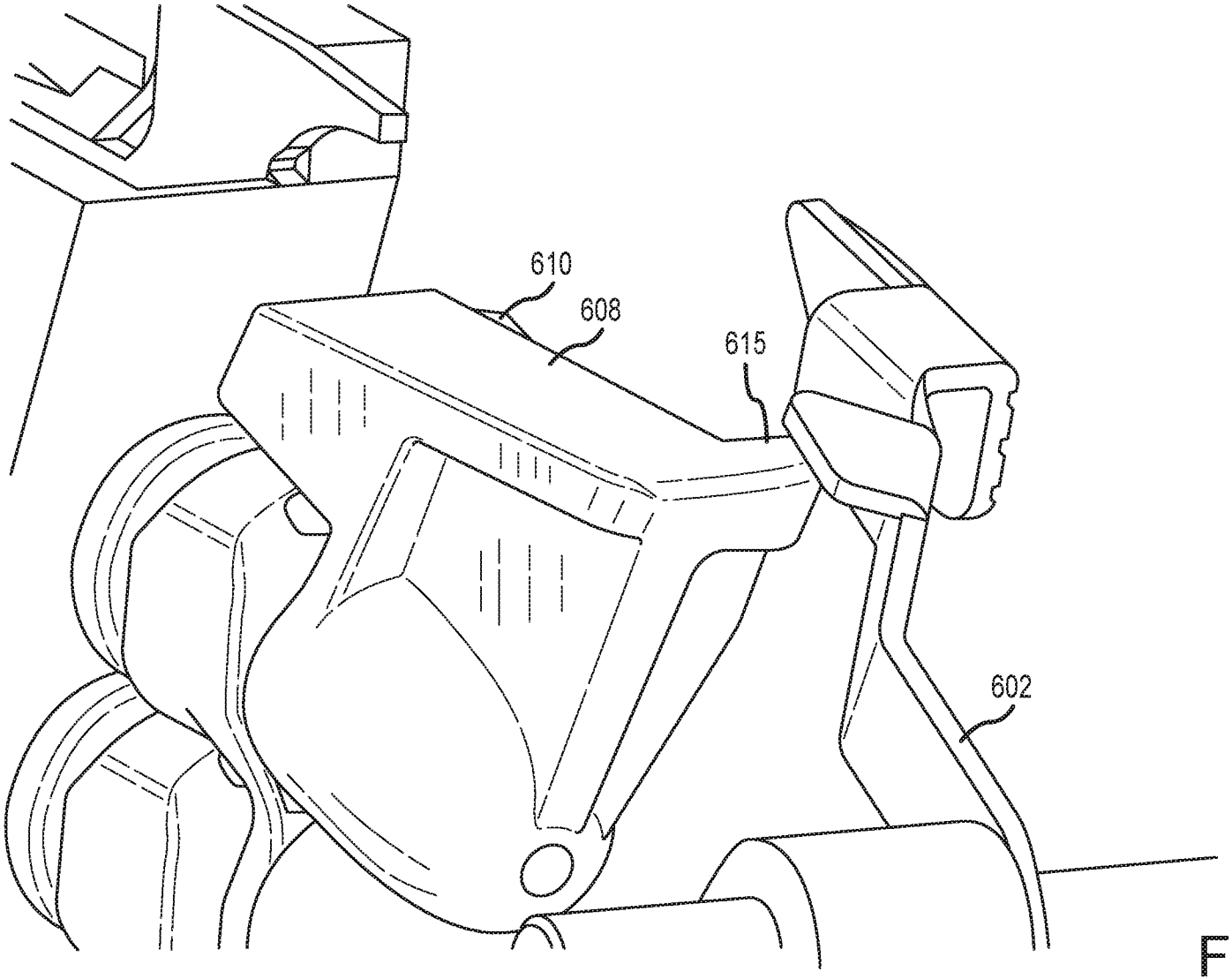
FIG. 9 illustrates another view of the first dummy cartridge of the follower assembly with the final live cartridge hidden of FIG. 6, but with the final live cartridge hidden and more of the follower assembly visible.

FIGS. 6-9 show an inside of the magazine showing the first dummy cartridge 604 and its interfacing with a slide lock mechanism 602. FIGS. 6-7 show the first dummy cartridge 604 making initial contact with the slide lock mechanism 602. This initial contact may occur as the final live cartridge is being moved into the chamber, but before the final live cartridge has left the angled follower platform 608, as this contact helps push the angled follower platform 608 toward the first side (e.g., a left side) of the magazine. FIGS. 8-9 show the dummy cartridge 604 at a moment later in time, where it has moved the slide lock mechanism 602 into a fully locked position. The angled follower platform 608 of the first dummy cartridge 604 can be angled such that a final live cartridge 606, along with pressure from the follower spring, for instance through a rotating arm, biases the first dummy cartridge 604 towards a first side of the magazine (e.g., a left side or a side opposing a protruding heel 615 (see FIG. 7)), thereby enabling or assisting the protruding heel 615 to engage with the slide lock mechanism 602. Without this angle to the angled follower platform 605, and the ensuing sideways translation and/or rotation of the first dummy cartridge 604 toward the first side of the magazine, the protruding heel 615 may miss or fail to engage with the slide lock mechanism 602.

The first dummy cartridge 604 can also include a rear stop 610 that interfaces with a downward-facing surface of the feed end of the magazine, as previously described, thereby causing a front 611 of the first dummy cartridge 604 to rotate upward and apply enhanced pressure on the slide lock mechanism 602.

The slide lock mechanism 602 can include an arm spanning between the trigger and a flange 609 for interfacing with the protruding heel 615. Behind the protruding heel 615 is seen a user interface that can extend through a frame of the firearm allowing a user to interact with the slide lock mechanism.

Figure 10:
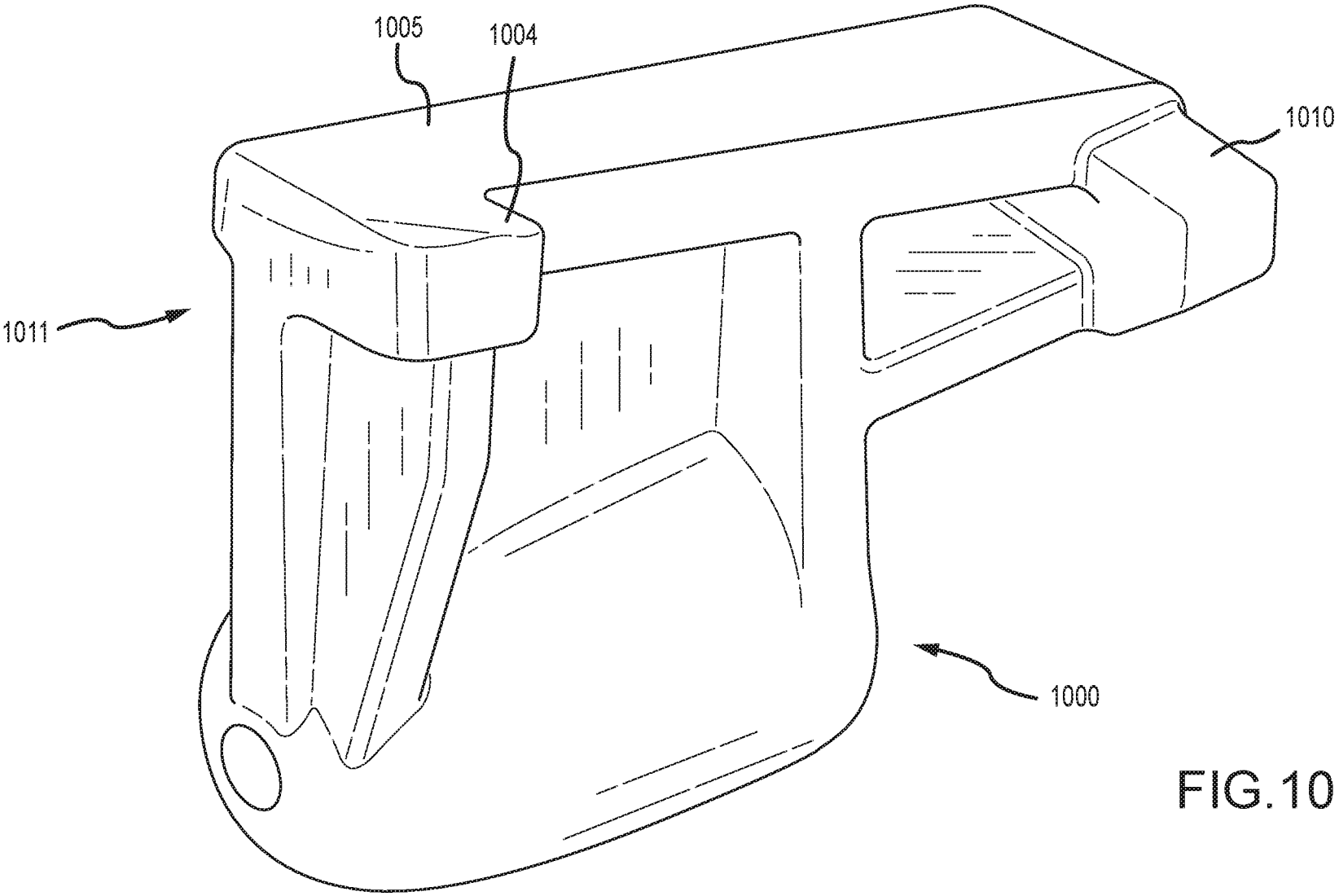
FIG. 10 illustrates a perspective view of an embodiment of a first dummy cartridge in isolation.
Figure 11:
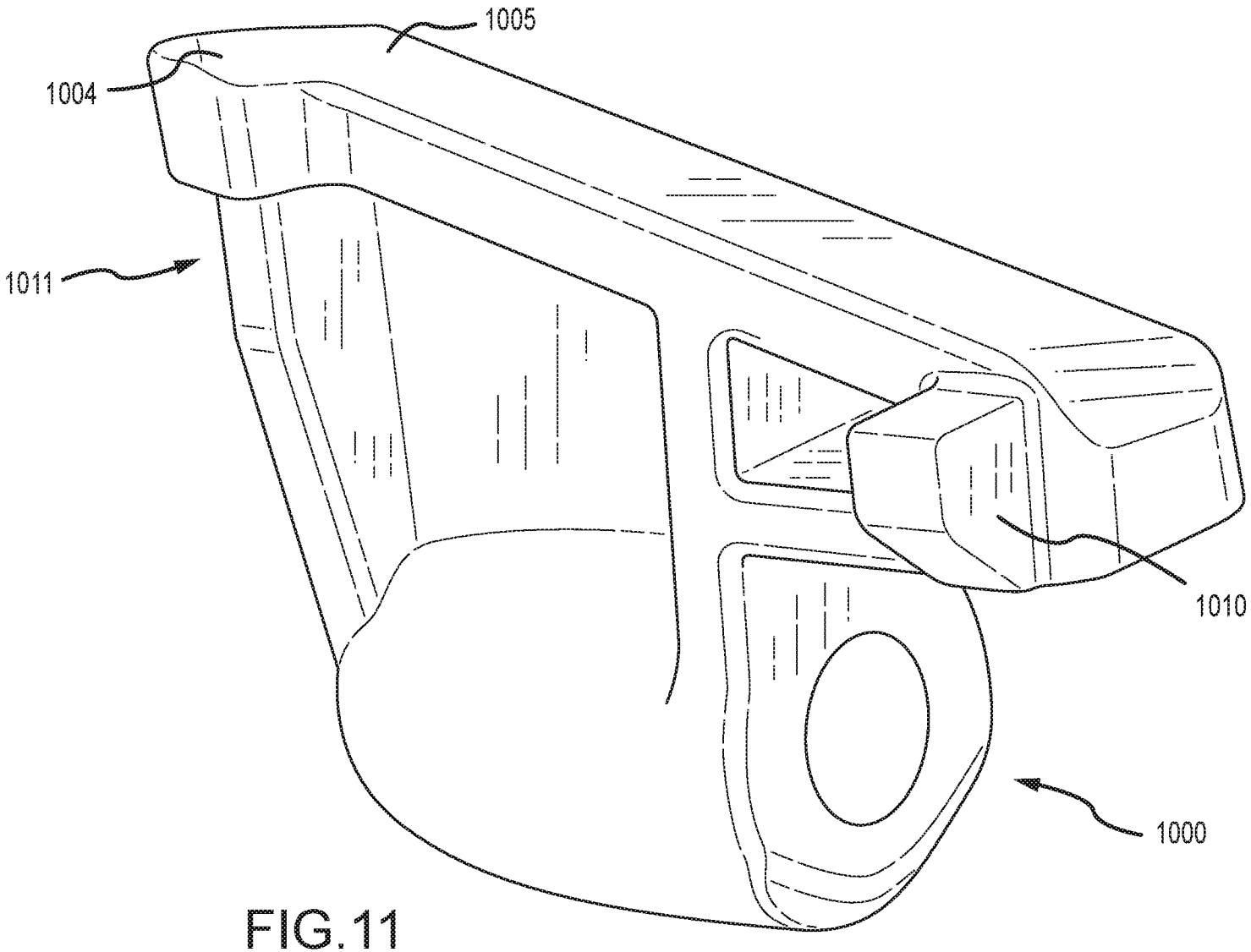
FIG. 11 illustrates another perspective view of the first dummy cartridge of FIG. 10.

FIGS. 10-11 show different views of an embodiment of a first dummy cartridge in isolation. The first dummy cartridge 1000 includes an angled follower platform 1005, a protruding heel 1004, a front 1011, and a rear stop 1010.

Figure 12:
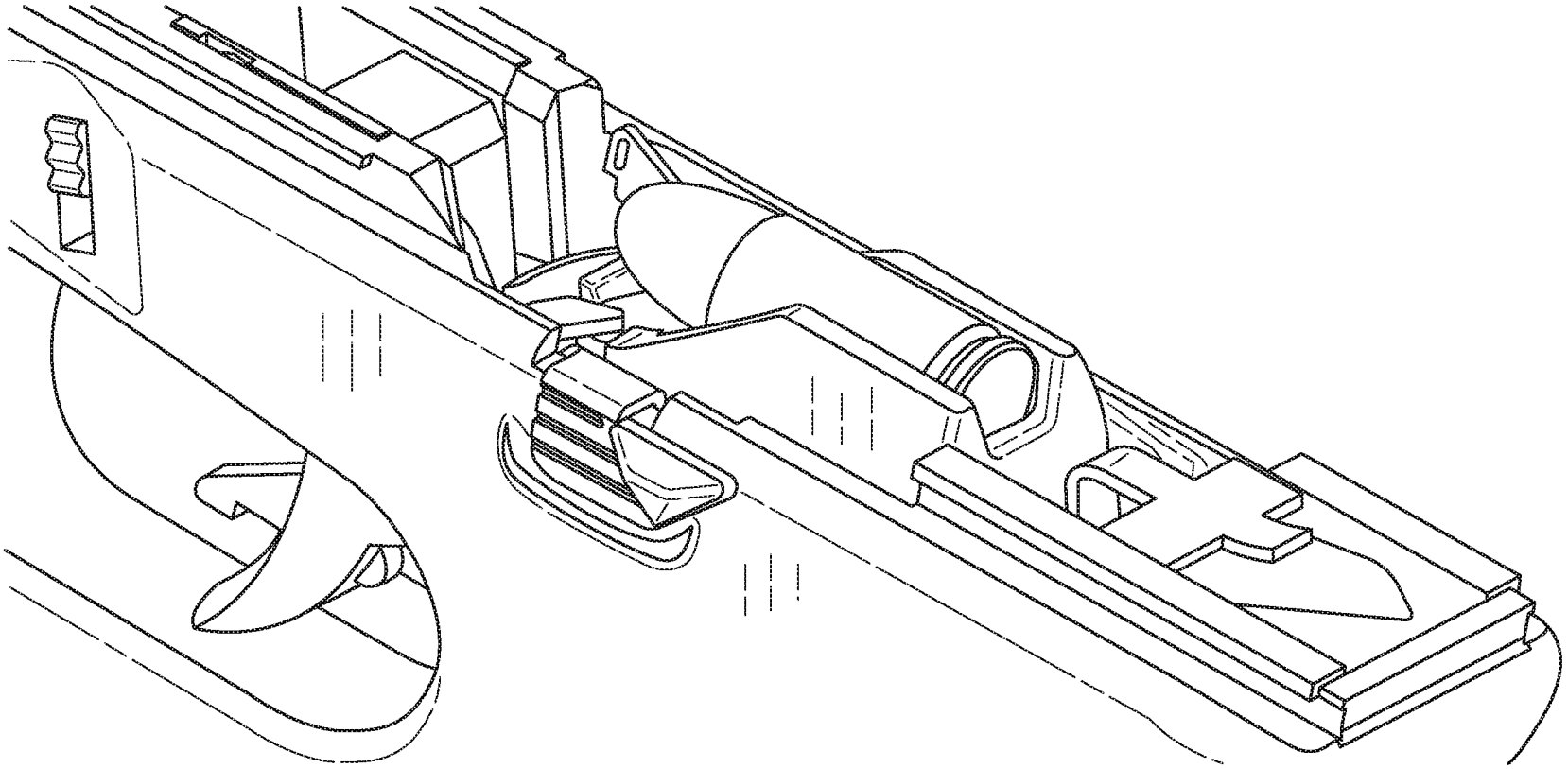
FIG. 12 illustrates a perspective view of a firearm with an embodiment of a magazine inserted therein, a final live cartridge in the magazine, and a slide assembly of the firearm hidden to enhance visibility of the feed end of the magazine.

FIG. 12 illustrates a perspective view of a firearm with an embodiment of a magazine inserted therein, a final live cartridge in the magazine, and an upper receiver of the firearm hidden to enhance visibility of the magazine.

Figure 13B:
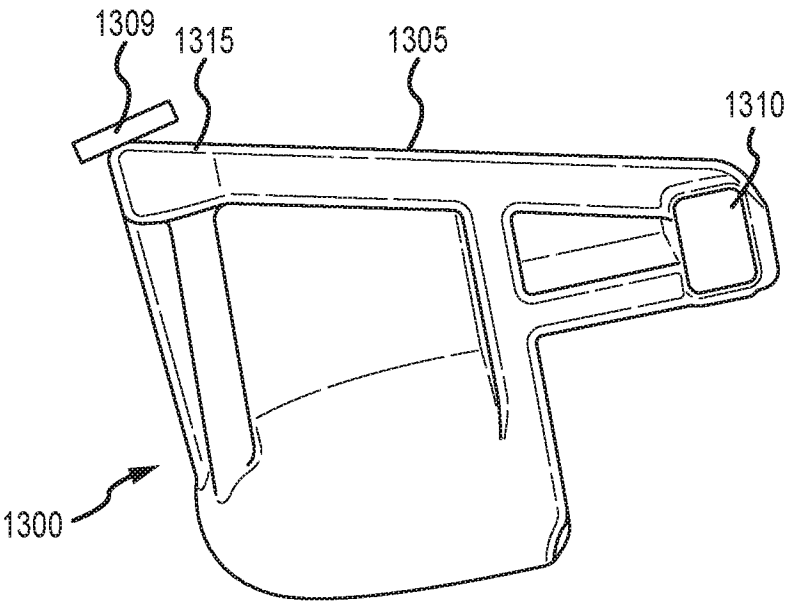
FIG. 13B illustrates a side cutaway view of the first dummy cartridge of FIG. 13A pushing the slide lock mechanism to a fully locked position.
Figure 13A:
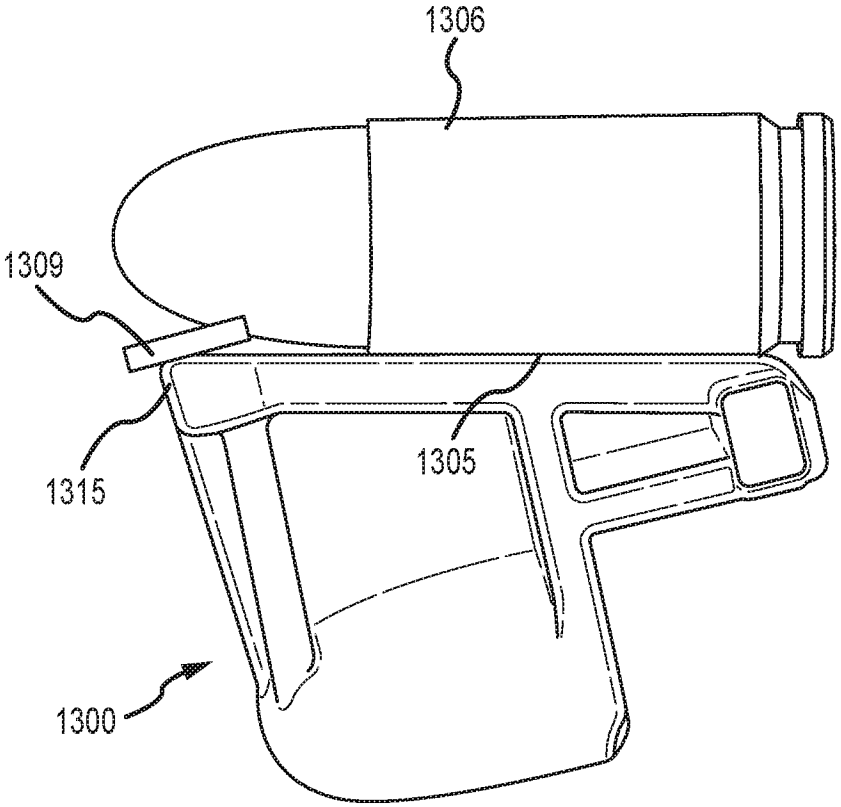
FIG. 13A illustrates a side cutaway view of an embodiment of a first dummy cartridge making initial contact with the slide lock mechanism.

FIG. 13A illustrates a side cutaway view of an embodiment of a first dummy cartridge making initial contact with the slide lock mechanism. At the moment of this initial contact the final live cartridge 1306 may still be resting on the angled follower platform 1305, although this timing is not required. In other embodiments, the final live cartridge 1306 may already have been moved out of the magazine when the protruding heel 1315 and the slide lock mechanism 1309 make first contact. Although FIG. 13A shows an embodiment where the angled follower platform 1305 is substantially horizontal or flat at this initial moment of contact, in other embodiments, the angled follower platform 1305 can include a tilt from front to back.

FIG. 13B illustrates a side cutaway view of the first dummy cartridge of FIG. 13A pushing the slide lock mechanism to a fully locked position. In this view the rear stop 1310 acts as a pivot axis forcing the front of the first dummy cartridge 1300 to rotate upward relative to this pivot axis. This causes the protruding heel 1315 to have a greater pressing force against the slide lock mechanism 1309 enhancing engagement therewith. One can see that the angled follower platform 1305 in FIG. 13A is tilted slightly backward in FIG. 13B and the slide lock mechanism 1309 is raised and rotated forward relative to its position in FIG. 13A. The rear stop 1310 can have a roughly rectangular shape and a top surface that is tilted back to front relative to a plane passing through a center of the final live cartridge 1306, or relative to a plane of the angled follower platform 1305.

The previous description of the disclosed embodiments is provided to enable any person skilled in the art to make or use the presently disclosed embodiments. Various modifications to these embodiments will be readily apparent to those skilled in the art, and the generic principles defined herein may be applied to other embodiments without departing from the spirit or scope of the presently disclosed embodiments. Thus, the presently disclosed embodiments are not intended to be limited to the embodiments shown herein but is to be accorded the widest scope consistent with the principles and novel features disclosed herein.

What is claimed is:

1. A follower assembly for a magazine comprising:

a first follower component having a front end, a rear end, and a first and second sides, and being part of a chain of follower components, the first follower component comprising:

an angled follower platform sloped from the first side to the second side;

a protruding heel extending substantially laterally from a front portion of the first side; and a rear stop extending from a rear portion of the first side and shaped to interface with a downward-facing surface of the magazine near a feed end of the magazine when the first follower component approaches the feed end, and cause a front end of the first follower component to rotate upward relative to the rear stop.

2. The follower assembly of claim 1, further comprising one or more additional follower components forming the chain with the first follower component and each movably linked to one or two other follower components.

3. The follower assembly of claim 2, wherein the angled follower platform is sloped to cause a rotation of the angled follower platform toward a first side of the magazine when only a final live cartridge remains in the magazine, wherein the first side of the follower component is configured to be proximal to the first side of the magazine.

4. The follower assembly of claim 1, wherein the angled follower platform is sloped to cause a rotation towards a first side of the magazine when only a final live cartridge remains in the magazine, wherein the first side of the follower component is configured to be proximal to the first side of the magazine.

5. The follower assembly of claim 1, wherein the magazine is a drum magazine.

6. The follower assembly of claim 1, wherein the first side is a left side.

7. The follower assembly of claim 1, wherein the angled follower platform includes a slide or bolt ramp at its back edge that is configured to push the follower assembly down when contacted by a forward-moving slide or bolt of a firearm.

8. The follower assembly of claim 1, wherein the rear stop has a top surface sloped from back to front.

9. The follower assembly of claim 1, further comprising one or more additional follower components forming a chain with the first follower component and each movably linked to one or two other follower components.

10. The follower assembly of claim 1, wherein the first follower component further comprises a cartridge-shaped portion below the angled follower platform.

11. The follower assembly of claim 10, wherein a rotational axis passes through the cartridge-shaped portion of the first follower component, a roller of the first follower component, and a hole through a link coupling the first and a second follower component, wherein a rotation of the angled follower platform toward a first side of the magazine is around this rotational axis.

12. The follower assembly of claim 1, further comprising a rotational axis passing through a lower portion of the first follower component, wherein the angled follower platform is sloped from front to back relative to the rotational axis.

13. The follower assembly of claim 1, wherein a top of the angled platform includes at least one curved portion.

14. A follower assembly for a magazine comprising:

a first follower component comprising a front end, a rear end, and a first and second sides, the first follower component comprising:

an angled follower platform sloped from the first side to the second side; and a protruding heel extending substantially laterally from a front portion of the first side; and one or more additional follower components forming a chain with the first follower component and each movably linked to one or two other follower components.

15. The follower assembly of claim 14, wherein the angled follower platform is sloped to cause a rotation toward a first side of the magazine when only a final live cartridge remains in the magazine, wherein the first side of the follower component is configured to be proximal to the first side of the magazine.

16. The follower assembly of claim 14, wherein the magazine is a drum magazine.

17. The follower assembly of claim 14, wherein the angled follower platform is sloped from front to back.

18. The follower assembly of claim 14, wherein the first side is a left side.

19. The follower assembly of claim 14, wherein the angled follower platform includes a slide or bolt ramp at its back edge that is configured to push the follower assembly down when contacted by a forward-moving slide or bolt of a firearm.

20. The follower assembly of claim 14, further comprising a rear stop extending laterally from a rear portion of the first side.

21. The follower assembly of claim 20, wherein the rear stop is arranged to interface with a downward-facing surface of the magazine near a feed end of the magazine when the first follower component approaches the feed end, and cause a front end of the first follower component to rotate upward relative to the rear stop.

22. The follower assembly of claim 21, wherein the rear stop has a top surface sloped from back to front.

23. The follower assembly of claim 14, wherein the first follower component is a dummy cartridge.

24. The follower assembly of claim 14, wherein a top of the angled platform includes at least one curved portion.

25. A method of fabricating a follower assembly for a magazine comprising:

forming a first follower component comprising a front end, a rear end, and a first and second sides, the first follower component comprising:

an angled follower platform sloped from the first side to the second side;

a protruding heel extending substantially laterally from a front portion of the first side; and a rear stop extending from a rear portion of the first side and shaped to interface with a downward-facing surface of the magazine near a feed end of the magazine when the first follower component approaches the feed end, and cause a front end of the first follower component to rotate upward relative to the rear stop; and forming one or more additional follower components and linking them to form a flexible chain including the first follower component.

26. The method of claim 25, further comprising forming the angled follower platform to cause to cause a rotation of the angled follower platform toward a first side of the magazine when only a final live cartridge remains in the magazine, wherein the first side of the angled follower platform is configured to be proximal to the first side of the magazine.

27. The method of claim 25, wherein the magazine is a drum magazine.

28. The method of claim 25, wherein the angled follower platform is sloped from front to back.

29. The method of claim 25, wherein the first side is a left side.

30. The method of claim 25, further comprising forming a slide or bolt ramp at a back edge of the angled follower platform that is configured to push the follower assembly down when contacted by a forward-moving slide or bolt of a firearm.

31. The method of claim 25, further comprising an angled top surface of the rear stop that slopes from back to front.

32. The method of claim 25, further comprising forming a cartridge-shaped portion as part of the first follower component below the angled follower platform.

33. The method of claim 25, further comprising forming at least one curved portion in a top of the angled follower platform.

34. A method of using a follower assembly for a magazine comprising:

loading a plurality of live cartridges into a box or drum magazine;

pressing the follower assembly down within the magazine, wherein the follower assembly comprises a flexible chain of linked follower components including a first follower component, the first follower component comprising:

an angled follower platform sloped from a first side to a second side;

a protruding heel extending substantially laterally from a front portion of the first side; and a rear stop extending from a rear portion of the first side and shaped to interface with a downward-facing surface of the magazine near a feed end of the magazine;

sequentially moving all but a final one of the plurality of live cartridges into a firearm from the magazine;

pressing the follower assembly upward against the final one of the plurality of live cartridges, a slope of the angled follower platform causing the first follower component to rotate toward a first side of the magazine, thereby causing the protruding heel of the angled follower platform to press upwardly on a slide lock mechanism and lock a slide of the firearm in a rearward position; and pressing a top surface of the rear stop against the downward-facing surface of the magazine near the feed end of the magazine such that a front end of the angled follower platform rotates upward enhancing upward pressing of the protruding heel against the slide lock mechanism.

35. The method of claim 34, wherein the first follower component is a dummy cartridge.

36. The method of claim 34, wherein a top of the angled platform includes at least one curved portion.

* * * * *